US011576422B2

(12) United States Patent
Reevell

(10) Patent No.: US 11,576,422 B2
(45) Date of Patent: Feb. 14, 2023

(54) AEROSOL-GENERATING ARTICLE HAVING ROD WITH MULTIPLE LONGITUDINAL ELONGATE ELEMENTS OF TOBACCO MATERIAL

(71) Applicant: Philip Morris Products S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 187 days.

(21) Appl. No.: 16/636,846

(22) PCT Filed: Aug. 8, 2018

(86) PCT No.: PCT/EP2018/071490
§ 371 (c)(1),
(2) Date: Feb. 5, 2020

(87) PCT Pub. No.: WO2019/030277
PCT Pub. Date: Feb. 14, 2019

(65) Prior Publication Data

US 2020/0359675 A1 Nov. 19, 2020

(30) Foreign Application Priority Data

Aug. 9, 2017 (EP) ..... 17185607

(51) Int. Cl.
*A24F 40/20* (2020.01)
*A24B 15/12* (2006.01)
(Continued)

(52) U.S. Cl.
CPC ..... *A24B 15/12* (2013.01); *A24D 1/02* (2013.01); *A24D 1/20* (2020.01)

(58) Field of Classification Search
CPC ..... A24F 40/00; A24F 40/20; A24B 15/12
See application file for complete search history.

(56) References Cited

U.S. PATENT DOCUMENTS 4,632,131 A 12/1986 Burnett et al.
5,353,816 A 10/1994 Ehling et al.
(Continued)

FOREIGN PATENT DOCUMENTS

CN 1144460 A 3/1997
CN 103561593 A 2/2014
(Continued)

OTHER PUBLICATIONS

International Search Report and Written Opinion dated Oct. 4, 2018 in PCT/EP2018/071490 filed Aug. 8, 2018.
(Continued)

*Primary Examiner* — Michael J Felton
*Assistant Examiner* — Yana B Krinker
(74) *Attorney, Agent, or Firm* — Oblon, McClelland, Maier & Neustadt, L.L.P.

(57) ABSTRACT

An aerosol-generating article for producing an inhalable aerosol when heated is provided, the aerosol-generating article including: a rod of aerosol-generating substrate, including: a plurality of elongate tubular elements of homogenised tobacco material assembled such that the plurality of elongate tubular elements extend in a longitudinal direction, and a wrapper circumscribing the plurality of elongate tubular elements, the plurality of elongate tubular elements being aligned substantially parallel to one another within the rod of aerosol-generating substrate.

16 Claims, 2 Drawing Sheets

(51) Int. Cl.
*A24D 1/20* (2020.01)
*A24D 1/02* (2006.01)

(56) References Cited

U.S. PATENT DOCUMENTS

| | | | | |
|---|---|---|---|---|
| 2005/0016549 | A1 | 1/2005 | Banerjee et al. | |
| 2014/0166032 | A1* | 6/2014 | Gindrat | A24B 15/12 131/353 |
| 2017/0055576 | A1* | 3/2017 | Beeson | A24D 1/22 |

FOREIGN PATENT DOCUMENTS

| | | | |
|---|---|---|---|
| CN | 203952405 | U | 11/2014 |
| CN | 106535668 | A | 3/2017 |
| EP | 0 822 670 | A2 | 2/1998 |
| EP | 2 760 303 | B1 | 5/2015 |
| EP | 2 814 342 | B1 | 3/2016 |
| EP | 2 713 778 | B1 | 4/2016 |
| JP | 2-138597 | U | 11/1990 |
| JP | 2003-532397 | A | 11/2003 |
| JP | 2017-500002 | A | 1/2017 |
| RU | 2 302 805 | C2 | 7/2007 |
| RU | 2 609 394 | C2 | 2/2017 |
| TW | 200946041 | A | 11/2009 |
| WO | WO 2009/022232 | A2 | 2/2009 |
| WO | WO 2011/101164 | A1 | 8/2011 |
| WO | WO 2012/164009 | A2 | 12/2012 |
| WO | WO 2013/178769 | A1 | 12/2013 |
| WO | WO 2013/190036 | A1 | 12/2013 |
| WO | WO 2015/082652 | A1 | 6/2015 |
| WO | WO 2016/023965 | A1 | 2/2016 |
| WO | WO 2017/068099 | A1 | 4/2017 |
| WO | WO 2018/122097 | A1 | 7/2018 |
| WO | WO 2019/030274 | A1 | 2/2019 |
| WO | WO 2019/030276 | A1 | 2/2019 |
| WO | WO 2019/030277 | A1 | 2/2019 |

OTHER PUBLICATIONS

Extended European Search Report dated Jan. 23, 2018, in Patent Application No. 17185607.3, 7 pages.
Combined Chinese Office Action and Search Report dated Sep. 26, 2021 in Patent Application No. 201880048381.7 (with English language translation), 19 pages.
Russian Federation Office Action dated Nov. 12, 2021 in Russian Federation Patent Application No. 2020103734/03(005670) (with English translation), 11 pages.
Combined Chinese Office Action and Search Report dated Mar. 18, 2022 in Chinese Patent Application No. 201880048381.7 (with English translation), 17 pages.
Notification of Reason for Refusal dated Oct. 11, 2022 in Japanese Patent Application No. 2020-506933 filed on Aug. 8, 2018, citing references 1-2, 15-17 therein, with translation, total 6 pages.

* cited by examiner

AEROSOL-GENERATING ARTICLE HAVING ROD WITH MULTIPLE LONGITUDINAL ELONGATE ELEMENTS OF TOBACCO MATERIAL

The present invention relates to an aerosol generating article comprising an aerosol-generating substrate.

Aerosol-generating articles in which an aerosol-generating substrate, such as a tobacco-containing substrate, is heated rather than combusted, are known in the art. Typically in such heated smoking articles, an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article.

Substrates for heated aerosol-generating articles have, in the past, typically been produced using randomly oriented shreds, strands, or strips of tobacco material. The formation of rods for heated smoking or aerosol-generating articles from shreds of tobacco material suffers from a number of disadvantages. For example, the process of shredding tobacco material undesirably generates tobacco fines and other waste. Rods comprising shreds of tobacco material may exhibit "loose ends", that is, a loss of shreds of tobacco material from the ends of the rods. Rods comprising shreds of tobacco material may exhibit high standard deviations in weight, partially due to the tendency of rods to exhibit loose ends. Also, rods comprising shreds of tobacco material tend to exhibit non-uniform densities, that is, the density along the length of the rod tends to be inconsistent due to variations in the quantity of tobacco material at different locations along the rod. Furthermore, loose ends may disadvantageously lead to the need for more frequent cleaning of an aerosol-generating device for use with the aerosol-generating article and of manufacturing equipment.

By way of example, international patent application WO-A-2012/164009 discloses rods for heated aerosol-generating articles formed from gathered sheets of tobacco material. The rods disclosed in WO-A-2012/164009 have a longitudinal porosity that allows air to be drawn through the rods. Effectively, folds in the gathered sheets of tobacco material define longitudinal channels through the rod. The use of rods formed from gathered sheets of homogenised tobacco material addresses some of the problems associated with forming an aerosol-generating substrate from shredded tobacco. However, such sheets typically have a relatively low tensile strength and so the gathering of the sheets to form the rods can have drawbacks.

International patent application WO-A-2011/101164 discloses alternative rods for heated aerosol-generating articles formed from strands of homogenised tobacco material, which may be formed by casting, rolling, calendering or extruding a mixture comprising particulate tobacco and at least one aerosol former to form a sheet of homogenised tobacco material. In an alternative embodiments, the rods of WO-A-2011/101164 may be formed from strands of homogenised tobacco material obtained by extruding a mixture comprising particulate tobacco and at least one aerosol former to form continuous lengths of homogenised tobacco material.

However, achieving consistent and accurate control of the amount of tobacco substrate in rods of the type described above can be difficult, particularly when operating at high speed. Further, depending on the shape and arrangement of sheets or strands of homogenised tobacco, it may be particularly difficult to control the porosity and resistance to draw (RTD) of the aerosol generating article. In addition, while they address some of the issues associated with forming an aerosol-generating substrate from shredded tobacco, rods formed from gathered sheets of homogenised tobacco material can have drawbacks because such sheets typically have a relatively low tensile strength.

Thus, it would be desirable to provide an aerosol generating article that enables accurate control of RTD. At the same time, it would be desirable to provide a substrate for one such aerosol generating article that facilitates the insertion of the heater into the substrate during use. It would be equally desirable to provide one such substrate or rod that can be manufactured efficiently and at high speed, as well as to provide a method of manufacturing such a rod.

According to an aspect of the present invention, there is provided an aerosol-generating article for producing an inhalable aerosol when heated, the aerosol-generating article comprising a rod of aerosol-generating substrate. The rod of aerosol-generating substrate comprises a plurality of elongate tubular elements of homogenised tobacco material assembled such that the elongate tubular elements extend in the longitudinal direction. Further, the rod of aerosol-generating substrate comprises a wrapper circumscribing the plurality of elongate tubular elements. The plurality of elongate tubular elements of homogenised tobacco material are aligned substantially parallel to one another within the rod of aerosol-generating substrate.

According to another aspect of the present invention, there is provided a rod for use as an aerosol-generating substrate in an aerosol-generating article, the rod comprising a plurality of elongate tubular elements of homogenised tobacco material assembled such that the elongate tubular elements extend in the longitudinal direction. Further, the rod of aerosol-generating substrate comprises a wrapper circumscribing the plurality of elongate tubular elements. The plurality of elongate tubular elements of homogenised tobacco material are aligned substantially parallel to one another within the rod of aerosol-generating substrate.

It will be appreciated that any features described with reference to one aspect of the present invention are equally applicable to any other aspect of the invention.

The term "aerosol generating article" is used herein to denote both articles wherein an aerosol generating substrate is heated and articles wherein an aerosol generating substrate is combusted, such as conventional cigarettes. As used herein, the term "aerosol generating substrate" denotes a substrate capable of releasing volatile compounds upon heating to generate an aerosol.

In heated aerosol generating articles, an aerosol is generated by heating a flavour generating substrate, such as tobacco, without combustion. Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention find particular application in aerosol generating systems comprising an electrically heated aerosol generating device having an internal heater blade which is adapted to be inserted into the rod of aerosol generating substrate. Aerosol generating articles of this type are described in the prior art, for example, in European patent application EP 0822670. As used herein, the term "aerosol generating device" refers to a device comprising a heater element that interacts with the aerosol generating substrate of the aerosol generating article to generate an aerosol. Alternatively, aerosol generating article according to the invention may comprise a combustible carbon heat source for heating the aerosol generating substrate during use. Aerosol generating articles of this type are described in the prior art, for example, in international patent application WO 2009/022232. Also known are aerosol generating articles in which a nicotine-containing aerosol is generated from a tobacco material, tobacco extract, or other nicotine source, without combustion, and in some cases without heating, for example through a chemical reaction. During smoking, volatile compounds are released from the aerosol forming substrate by heat transfer from the fuel element and entrained in air drawn through the aerosol generating article. As the released compounds cool they condense to form an aerosol.

As used herein, the term "tubular element" denotes a hollow elongate element defining a lumen or airflow passage along a longitudinal axis thereof. In the context of the present specification, the term "tubular" is intended to encompass any substantially tubular element, such as an elongate element having a C-shaped cross-section, as would be the case if a slit extended over the entire length of the tubular element.

In some embodiments, a tubular element may be formed by winding a strip of homogenised tobacco material about its longitudinal axis. In general, to form a tubular element, a strip of homogenised tobacco material is wound about the longitudinal axis by at least 360 degrees. In some embodiments, the strip of homogenised tobacco material is wound about the longitudinal axis at least 1.5 times, that is by at least 540 degrees. To form a "substantially tubular element", a strip of homogenised tobacco material is wound about the longitudinal axis by about 360 degrees, such as by at least about 300 degrees, preferably by at least about 330 degrees, even more preferably by at least about 345 degrees.

As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article in the longitudinal direction. For example, it may be used to denote the dimension of the rod or of the elongate tubular elements in the longitudinal direction.

The term "thickness of a tubular element" is used in the present specification to denote the minimum distance measured between the outer surface and the inner surface of a tubular element. In practice, the distance at a given location is measured along a direction locally substantially perpendicular to the outer surface and the inner surface of the tubular element. For a tubular element having a substantially circular cross-section, the distance is measured along a substantially radial direction of the tubular element. In those embodiments where a tubular element is formed by winding a strip of homogenised tobacco material about the longitudinal axis by less than 720 degrees (that corresponds to a double winding of the material), the thickness of the tubular element substantially corresponds to the thickness of the web material from which the strip is cut, and so it can be measured as the minimum distance measured between two opposite surfaces of the web material.

The term "equivalent diameter of a tubular element" is used herein to denote the diameter of the circle which has the same surface area as the transverse internal cross-section of the tubular element. In general, the transverse internal cross-section of a tubular element may have any shape, although a circular or quasi-circular shape, such as an oval or elliptic shape is preferred. For a tubular element having a circular transverse internal cross-section, the equivalent diameter is the diameter of the cross-section of the tubular element.

As used herein, the term "homogenised tobacco material" encompasses any tobacco material formed by the agglomeration of particles of tobacco material. Sheets or webs of homogenised tobacco material are formed by agglomerating particulate tobacco obtained by grinding or otherwise powdering of one or both of tobacco leaf lamina and tobacco leaf stems. In addition, homogenised tobacco material may comprise one or more of tobacco dust, tobacco fines, and other particulate tobacco by-products formed during the treating, handling and shipping of tobacco as well as binder, aerosol formers, flavours, other non-tobacco materials, like other plant material, including fibres and others. The sheets of homogenised tobacco material may be produced by casting, extrusion, paper making processes or other any other suitable processes known in the art.

The term "porous" is used herein to refer to a material that provides a plurality of pores or openings that allow the passage of air through the material.

As used herein, the terms "upstream" and "downstream" describe the relative positions of elements, or portions of elements, of the aerosol-generating article in relation to the direction in which the aerosol is transported through the aerosol-generating article during use.

As briefly described above, the aerosol generating article of the present invention incorporates a rod of aerosol-generating substrate. The rod of aerosol-generating substrate comprises a plurality of elongate tubular elements of homogenised tobacco material assembled such that the elongate tubular elements extend in the longitudinal direction and are aligned substantially parallel to one another within the rod of aerosol-generating substrate. These elongate tubular elements are circumscribed by a wrapper.

By adjusting the number, equivalent diameter and thickness of the elongate tubular elements in the rod, it is advantageously possible to adjust the density and porosity of the rod. In general, aerosol-generating substrates comprising a plurality of elongate tubular elements of homogenised tobacco in accordance with the invention advantageously exhibit more uniform densities than aerosol-generating substrates comprising shreds of tobacco material. The geometry of the elongate tubular elements is such that particularly stable channels are provided for airflow along the rod. This advantageously allows a consistent fine tuning of RTD, such that aerosol-generating substrates having a predetermined RTD can be manufactured consistently and with great precision.

The weight of an aerosol-generating substrate comprising elongate tubular elements of homogenised tobacco is determined by the number, size, density and spacing of the tubular elements. Thus, the weight of aerosol-generating substrates in accordance with the present invention can advantageously be regulated by controlling the density, dimensions, aerosol-former load where present and spacing of the tubular elements. This reduces inconsistencies in weight between aerosol-generating substrates of the same dimensions.

Variations in the thickness of the elongate tubular elements in the rod may also be advantageously used to adjust the content of homogenised tobacco in the rod. For example, in a tubular element formed from a rolled strip of homogenised tobacco web an adjustment of the thickness of the tubular element may be achieved by varying the number of convolutions of the strip about the longitudinal axis or by varying the thickness of the homogenised tobacco web itself. This imparts an increased design flexibility to aerosol-generating articles in accordance compared with aerosol-generating articles comprising shreds of tobacco material.

The size, geometry and arrangement of the elongate tubular elements in the rod can be readily adapted to facilitate the insertion of a heating element in the rods of aerosol-generating articles in accordance with the present invention. Because the tubular elements lie substantially straight within the rod and extend longitudinally, insertion of a longitudinally extending heating element, such as a heater blade, is greatly facilitated. The regular arrangement of the elongate tubular elements in the rod can also advantageously favour optimisation of heat transfer from the heating element through the rod.

Insertion of a heater element of an aerosol-generating device into an aerosol-generating substrate comprising shreds of tobacco material and withdrawal of a heater element of an aerosol-generating device into an aerosol-generating substrate comprising shreds of tobacco material may tend to dislodge shreds of tobacco material from the aerosol-generating substrate. This can disadvantageously result in the need for more frequent cleaning of the heater element and other parts of the aerosol-generating device in order to remove the dislodged shreds. In contrast, insertion and withdrawal of a heater element of an aerosol-generating device into an aerosol-generating substrate comprising a plurality of elongate tubular elements of homogenised tobacco material advantageously has a significantly reduced tendency to dislodge material.

Rods in accordance with the present invention can be made in a continuous process which can be efficiently carried out at high speed, and can be conveniently incorporated into existing production lines for the manufactured of heated aerosol generating articles.

The rod of aerosol generating substrate preferably has an external diameter that is approximately equal to the external diameter of the aerosol generating article.

Preferably, the rod of aerosol generating substrate has an external diameter of at least 5 millimetres. The rod of aerosol generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol generating substrate has an external diameter of 7.2 millimetres, to within 10 percent.

The rod of aerosol generating substrate may have a length of between about 5 millimetres and about 100 mm. Preferably, the rod of aerosol generating substrate has a length of at least about 5 millimetres, more preferably at least about 7 millimetres. In addition, or as an alternative, the rod of aerosol generating substrate preferably has a length of less than about 25 millimetres, more preferably less than about 20 millimetres. In one embodiment, the rod of aerosol generating substrate may have a length of about 10 millimetres. In a preferred embodiment, the rod of aerosol generating substrate has a length of about 12 millimetres.

Preferably, the rod of aerosol generating substrate has a substantially uniform cross-section along the length of the rod. Particularly preferably, the rod of aerosol generating substrate has a substantially circular cross-section.

Aerosol generating articles in accordance with the present invention comprise an aerosol generating substrate, which may be provided as a rod comprising elongate tubular elements of homogenised tobacco material circumscribed by a wrapper. The elongate tubular elements are assembled such that the elongate tubular elements extend in the longitudinal direction.

As used herein, the term 'rod' is used to denote a generally cylindrical element of substantially circular, oval or elliptical cross-section.

The plurality of elongate tubular elements of the rod of aerosol-generating articles according to the invention are formed of a homogenous tobacco material, which preferably comprises particulate tobacco obtained by grinding or otherwise comminuting tobacco leaf lamina. The plurality of elongate tubular elements may all have substantially the same composition as each other. Alternatively, the plurality of elongate tubular elements may include tubular elements of at least two different compositions.

Preferably, at least one elongate tubular element in the rod comprises a rolled strip cut from a sheet or web of homogenised tobacco material.

Sheets or webs of homogenised tobacco material for use in the invention may have a tobacco content of at least about 40 percent by weight on a dry weight basis, more preferably of at least about 60 percent by weight on a dry weight basis, more preferably or at least about 70 percent by weight on a dry basis and most preferably at least about 90 percent by weight on a dry weight basis.

Sheets or webs of homogenised tobacco material for use in the aerosol-generating substrate may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-generating substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets or webs of homogenised tobacco material for use in the aerosol-generating substrate are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets or webs of homogenised tobacco material for use in the aerosol-generating substrate are known in the art and include, but are not limited to: cellulose fibers; soft-wood fibres; hard-wood fibres; jute fibres and combinations thereof. Prior to inclusion in sheets of homogenised tobacco material for use in the aerosol-generating substrate, non-tobacco fibres may be treated by suitable processes known in the art including, but not limited to: mechanical pulping; refining; chemical pulping; bleaching; sulfate pulping; and combinations thereof.

Preferably, the sheets or webs of homogenised tobacco material comprise an aerosol former. As used herein, the term "aerosol former" describes any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as propylene glycol, triethylene glycol, 1,3-butanediol and, most preferred, glycerine.

The sheets or webs of homogenised tobacco material may comprise a single aerosol former. Alternatively, the sheets or webs of homogenised tobacco material may comprise a combination of two or more aerosol formers.

Preferably, the sheets or webs of homogenised tobacco material have an aerosol former content of greater than 5 percent on a dry weight basis. The sheets of homogenised tobacco material may have an aerosol former content of between approximately 5 percent and approximately 30 percent on a dry weight basis. In a preferred embodiment, the sheets of homogenised tobacco material have an aerosol former content of approximately 20 percent on a dry weight basis.

Sheets or webs of homogenised tobacco for use in the aerosol-generating article of the present invention may be made by methods known in the art, for example the methods disclosed in International patent application WO-A-2012/164009 A2. In a preferred embodiment, sheets of homogenised tobacco material for use in the aerosol-generating article are formed from a slurry comprising particulate tobacco, guar gum, cellulose fibres and glycerine by a casting process.

As an alternative, elongate tubular elements of homogenised tobacco material for use in an aerosol-generating substrate in accordance with the invention may be formed by extrusion. By way of example, a slurry comprising particulate tobacco obtained by grinding or otherwise comminuting tobacco leaf lamina may be pushed through a die of the desired cross-section. As a further alternative, a 3D printing process may also be used for manufacturing tubular elements of homogenised tobacco material.

The elongate tubular element may have an equivalent diameter from about 0.1 millimetres to about 3 millimetres. Preferably, the elongate tubular element has an equivalent diameter of at least about 0.3 millimetres. More preferably, the elongate tubular element has an equivalent diameter of at least about 0.5 millimetres.

In addition, or as an alternative, the elongate tubular element preferably has an equivalent diameter of less than about 2 millimetres. More preferably, the elongate tubular element has an equivalent diameter of less than about 1 millimetre.

In some embodiments, the elongate tubular element preferably has an equivalent diameter from about 0.3 millimetres to about 2.7 millimetres. In other embodiments, the elongate tubular element preferably has an equivalent diameter from about 0.5 millimetres to about 1.1 millimetres.

Where the tubular element is formed by rolling a strip of homogenised tobacco material, the strip may have a width of at least about 1 millimetre. Preferably, the strip of homogenised tobacco material has a width of at least about 2 millimetres. More preferably, the strip of homogenised material has a width of at least about 3 millimetres.

In some embodiments, the strip of homogenised tobacco material preferably has a width from about 1 millimetre to about 8.2 millimetres. In other embodiments, the strip of homogenised tobacco material preferably has a width from about 2.4 millimetres to about 3.5 millimetres.

Preferably, the strip of homogenised tobacco material is cut from a sheet or web having a thickness of at least about 40 microns, more preferably at least about 60 microns, more preferably at least about 80 microns and most preferably at least about 100 microns. Alternatively or in addition, the strip of homogenised tobacco material is preferably cut from a sheet or web having a thickness of no more than about 5000 microns, more preferably no more than about 2000 microns, more preferably no more than about 1000 microns and most preferably no more than about 500 microns. For example, the thickness of the sheet or web may be between about 40 microns and about 5000 microns, more preferably between about 60 microns and about 2000 microns, more preferably between about 80 microns and about 1000 microns, and most preferably by between about 100 microns and about 500 microns.

A thickness of the elongate tubular element is preferably at least about 40 microns, more preferably at least about 80 microns, more preferably at least about 120 microns and most preferably at least about 160 microns. In addition or as an alternative, a thickness of the elongate tubular element is preferably less than about 5000 microns, more preferably less than about 3000 microns, and most preferably less than about 1000 microns.

In preferred embodiments, the tubular elements are formed of a porous tobacco material, such that air flow through the wall of the tubular element—that is, airflow along a substantially radial direction in the rod—is not impeded. Where the tubular element is formed by rolling a strip of homogenised tobacco material the strip itself may be formed of a porous tobacco material.

As used herein with reference to a homogenised tobacco material, the term "porous" may indicate that the tobacco material has been produced within an inherent porosity so that sufficient pores or interstices are provided within the structure of a sheet or web such as to enable the flow of air through the sheet or web in a direction transverse to a surface of the sheet or web. Alternatively or in addition, the term "porous" may indicate that each sheet or web of tobacco material comprises a plurality of air flow holes to provide the desired porosity. For example, a sheet of tobacco material may be punctured with a pattern of air flow holes prior to undergoing the rolling operation that produces the elongate tubular elements of the rod of aerosol-generating substrate. The air flow holes may be punctured randomly or uniformly over the sheet. The pattern of air flow holes may cover substantially the full surface of the sheet, or may cover one or more specific areas of the sheet, with the remaining areas being free from air flow holes.

Preferably, the strip of homogenised tobacco material from which the tubular element is formed is textured. As used herein the term "textured" refers to a sheet or web that has been crimped, embossed, debossed, perforated or otherwise locally deformed. For example, the sheet or web from which the strip is cut may comprise a plurality of spaced-apart indentations, protrusions, perforations or a combination thereof. Texture may be provided on one side of each sheet, or on both sides each sheet.

In a particularly preferred embodiment, the strip is crimped. As used herein, the term "crimped" denotes a sheet or web or part thereof having a plurality of substantially parallel ridges or corrugations. The inclusion of one or more tubular elements formed from a crimped strip may help to provide and retain some spacing between adjacent tubular elements within the rod.

Alternatively or in addition to the provision of texture on the surface of at least one of the plurality of tubular elements, an additive may be applied to at least a part of a surface of at least one of the plurality of tubular elements. The additive may be a solid additive, a liquid additive, or a combination of a solid additive and a liquid additive. Suitable solid and liquid additives for use in the invention are known in the art and include, but are not limited to: flavourants, such as for example menthol; adsorbents, such as for example activated carbon; fillers, such as for example calcium carbonate; and botanical additives.

To form a substantially tubular element, the strip of homogenised tobacco material is wound about the longitudinal axis by at least about 330 degrees. Preferably, the strip of homogenised tobacco material is wound about the longitudinal axis by at least about 360 degrees. More preferably, the strip of homogenised tobacco material is wound about the longitudinal axis by at least about 540 degrees. In addition, or as an alternative, the strip of homogenised tobacco material is preferably wound about the longitudinal axis by less than about 1800 degrees. More preferably, the strip of homogenised tobacco material is wound about the longitudinal axis by less than about 900 degrees. In some preferred embodiments, the strip of homogenised tobacco material is wound about the longitudinal axis by from about 345 to about 540 degrees.

Preferably, each elongate tubular element has a length substantially equal to the length of the rod of aerosol generating substrate. In one embodiment, each tubular element has a length of between about 5 millimetres and about 80 millimetres. In a preferred embodiment, each tubular element has a length of between about 7 millimetres and about 40 and most preferably, each tubular element has a length of between about 8 millimetres and about 28 millimetres.

Preferably the rod of aerosol generating substrate comprises less than about 200 elongate tubular elements of homogenised tobacco material. More preferably, the rod of aerosol generating substrate comprises less than about 150 tubular elements. Even more preferably, the rod of aerosol generating substrate comprises less than about 100 tubular elements.

In addition, or as an alternative, the rod of aerosol generating substrate preferably comprises at least about 7 tubular elements of homogenised tobacco material. More preferably, the rod of aerosol generating substrate comprises at least about 30 tubular elements. Even more preferably, the rod of aerosol generating substrate comprises at least about 40 tubular elements. In particularly preferred embodiments, the rod of aerosol generating substrate comprises from about 7 to about 100 strands of non-tobacco material.

Preferably, the elongate tubular elements of homogenised tobacco material are of substantially oval cross-section, substantially elliptical transverse cross-section or substantially circular transverse cross-section. As described above, tubular elements for use in aerosol-generating articles in accordance with the present invention may effectively be formed by winding a strip of homogenised tobacco material about its longitudinal axis by slightly less than 360 degrees. This results in an element having more or less closed C-shaped cross-section, wherein a slit extends longitudinally over the entire length of the tubular element. One such tubular element may be regarded as having an oval cross-section, a substantially elliptical transverse cross-section or a substantially circular transverse cross-section.

As described above, the plurality of elongate tubular elements forming the rod of aerosol-generating substrate are circumscribed by a wrapper. The wrapper may be formed of a porous or non-porous sheet material. The wrapper may be formed of any suitable material or combination of materials. Preferably, the wrapper is a paper wrapper. The wrapper may optionally be adhered to the outer edges of the plurality of tubular elements. For example, at least one of the inner surface of the wrapper and the outer edges of the plurality of tubular elements may be wetted during the production process such that the inner wrapper adheres to the edges of the tubular elements during the wrapping process. Alternatively, an adhesive may be applied to at least one of the inner surface of the wrapper and the outer edges of the plurality of tubular elements upstream of the wrapping step. The adhesion of the plurality of tubular elements and the wrapper may advantageously help to retain the position and spacing of the plurality of tubular elements within the rod.

The wrapper may optionally be at least partially folded over the tubular elements at the upstream and downstream ends of the rod to retain the plurality of tubular elements within the rod. Preferably, the wrapper overlies the periphery of the plurality of tubular elements at the upstream and downstream ends of the rod so that the remainder of the tubular elements is exposed. However, in some embodiments the wrapper may overlie the entire upstream and downstream ends of the rod. In such embodiments, air flow may advantageously be made possible by providing a wrapper having a sufficient porosity to enable air flow through the ends of the rod.

As an alternative to folding the ends of the wrapper over the upstream and downstream ends of the tubular elements, a separate rim section of paper or other material may be attached to the wrapper to overlie at least the periphery of the upstream and downstream ends of the tubular elements, as described above. In such embodiments where the wrapper is folded over the ends of the rod, or where a separate rim section is provided, an additional outer wrapper may be provided overlying the wrapper that circumscribes the plurality of tubular elements.

The aerosol-generating articles according to the invention preferably comprise one or more elements in addition to the rod of aerosol-generating substrate, wherein the rod and the one or more elements are assembled within a substrate wrapper. For example, aerosol-generating articles according to the invention may further comprise at least one of: a mouthpiece, an aerosol-cooling element and a support element such as a hollow acetate tube. For example, in one preferred embodiment, an aerosol-generating article comprises, in linear sequential arrangement, a rod of aerosol-generating substrate as described above, a support element located immediately downstream of the aerosol-generating substrate, an aerosol-cooling element located downstream of the support element, and an outer wrapper circumscribing the rod, the support element and the aerosol-cooling element.

A rod for use in an aerosol-generating article as described above may be manufactured by a method as set out below. In a first step of the method, there is provided a sheet or web of homogenised tobacco material. In a second step, an elongate strip having a longitudinal axis is cut from the sheet or web of homogenised tobacco material. The cutting operation may be carried out by feeding the sheet or web from a roll or bobbin and by moving it in continuous fashion along a predetermined direction. Cutting means are provided at a cutting station to which the web or sheet is fed. To this purpose, mechanical cutters may be used. As an alternative, lasers can also be used.

In a third step, the strip is rolled, that is, wound about the longitudinal axis to form an elongate substantially tubular element. This may be achieved by feeding the strip along a predetermined direction to a funnel shaped element, such that the strip is coiled and shaped into a rolled substantially tubular element. Several individual rolled substantially tubular elements may be manufactured in parallel.

In a fourth step, a plurality of elongate substantially tubular element obtained at the end of the third step are collated and assembled such that the elongate tubular elements extend in the longitudinal direction and aligned substantially parallel to one another. This may be achieved by feeding the plurality of elongate substantially tubular elements through another funnel element such that they are grouped in a substantially cylindrical cluster.

In a fifth step, the assembled tubular elements are circumscribed with a wrapper to form a continuous rod. In a sixth step, the continuous rod is severed into a plurality of discrete rods.

In a preferred embodiment, the method comprises a further step of applying at least one aerosol former to the sheet or web of homogenised material prior to the step of cutting the sheet or web to obtain the strip. In an alternative embodiment, the method comprises a further step of applying at least one aerosol former to the elongate tubular elements prior to the step of collating and assembling the plurality of elongate tubular members.

In one further alternative, the method may comprise a further step of applying at least one aerosol former to the plurality of elongate tubular elements after they have been collated and assembled. As one additional alternative, the method may comprise a step of applying at least one aerosol former to the plurality of elongate tubular elements following the step of severing the continuous rod into discrete rods.

In preferred embodiments, the method may further comprise a step of drying the homogenised tobacco material after the step of applying the at least one aerosol former.

The steps of circumscribing the plurality of strands with the wrapper to form a continuous rod and severing the continuous rod to form discrete rods may be carried out using existing apparatus and techniques, which would be known to the skilled person.

The invention will now be further described with reference to the figures in which.

Figure 1:
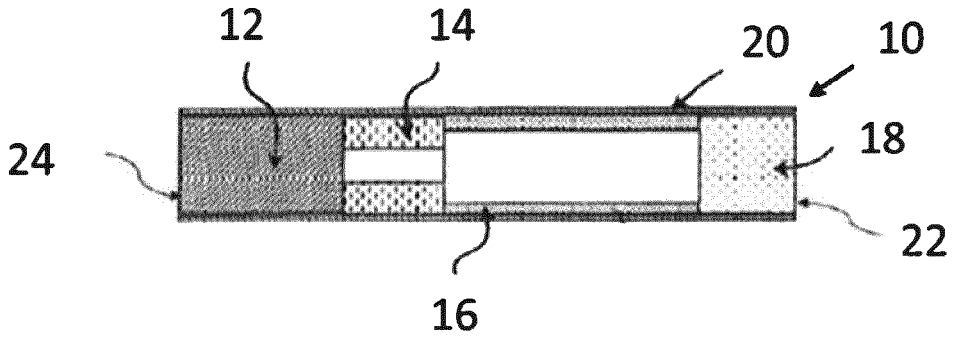
FIG. 1 shows a schematic longitudinal cross-sectional view of an aerosol-generating article for use with an aerosol-generating device comprising a heater element.

The aerosol-generating article 10 shown in FIG. 1 comprises a rod of aerosol-generating substrate 12, a hollow cellulose acetate tube 14, a spacer element 16 and a mouthpiece filter 18. These four elements are arranged sequentially and in coaxial alignment and are circumscribed by a substrate wrapper 20 to form the aerosol-generating article 10. The aerosol-generating article 10 has a mouth end 22 and a distal end 24 located at the opposite end of the article to the mouth end 22. The aerosol-generating article 10 shown in FIG. 1 is particularly suitable for use with an electrically operated aerosol-generating device comprising a heater for heating the rod of aerosol-generating substrate.

The rod of aerosol-generating substrate 12 has a length of approximately 12 millimetres and a diameter of approximately 7 millimetres. The rod 12 is cylindrical in shape and has a substantially circular cross-section.

Figure 2:
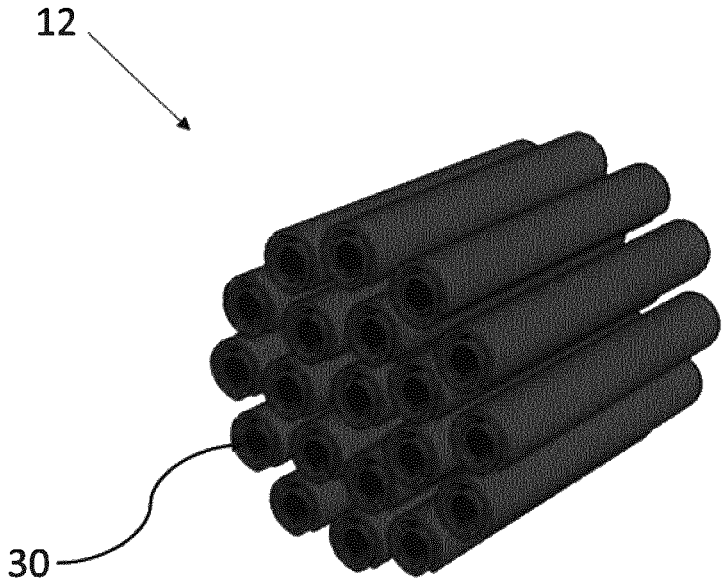
FIG. 2 shows a schematic perspective view of an aerosol-generating substrate according to a first embodiment of the invention, with the wrapper removed.
Figure 3:
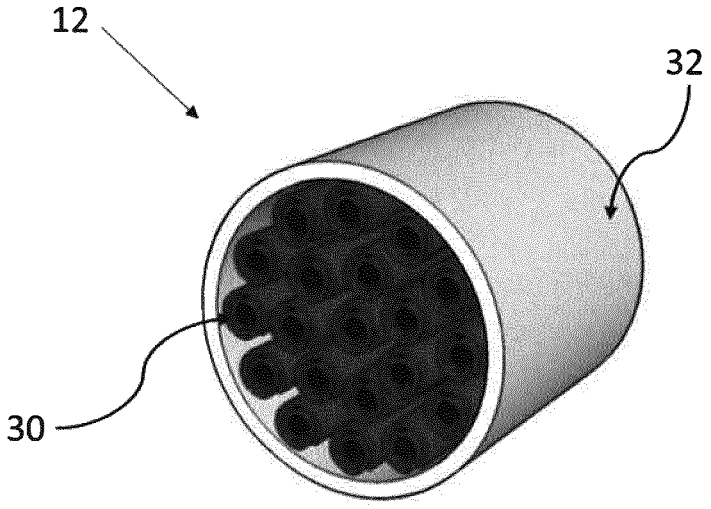
FIG. 3 shows a schematic perspective view of the aerosol-generating substrate of FIG. 2, with the wrapper in place.

An embodiment of a rod of aerosol-generating substrate 12 for use in the aerosol-generating article 10 of FIG. 1 is shown in FIGS. 2 and 3. The rod 12 comprises a plurality of elongate substantially tubular elements 30 circumscribed by a paper wrapper 32. In FIG. 2, the plurality of tubular elements 30 are shown with the wrapper 32 removed.

As can be seen in FIG. 2, each of the tubular elements 30 comprises a rolled strip of homogenised tobacco material and extends in the longitudinal direction and has a length substantially corresponding to the length of the rod 12. The tubular elements 30 are parallel to each other and stacked such that adjacent tubular elements are in contact with each other. The tubular elements 30 have substantially circular cross-section and an equivalent diameter of about 1 millimetre. In the embodiment of FIGS. 2 and 3, the rod comprises 20 elongate tubular elements 30. Longitudinal channels extending through the rod 12 are internally defined by the tubular elements. Further, longitudinal channels extending through the rod 12 are also defined among the tubular elements. Thus, the rod 12 is adapted to receive a heater blade of an aerosol-generating device, as described below, and to provide an air flow pathway through which air can be drawn through the rod 12 during use.

Figure 4:
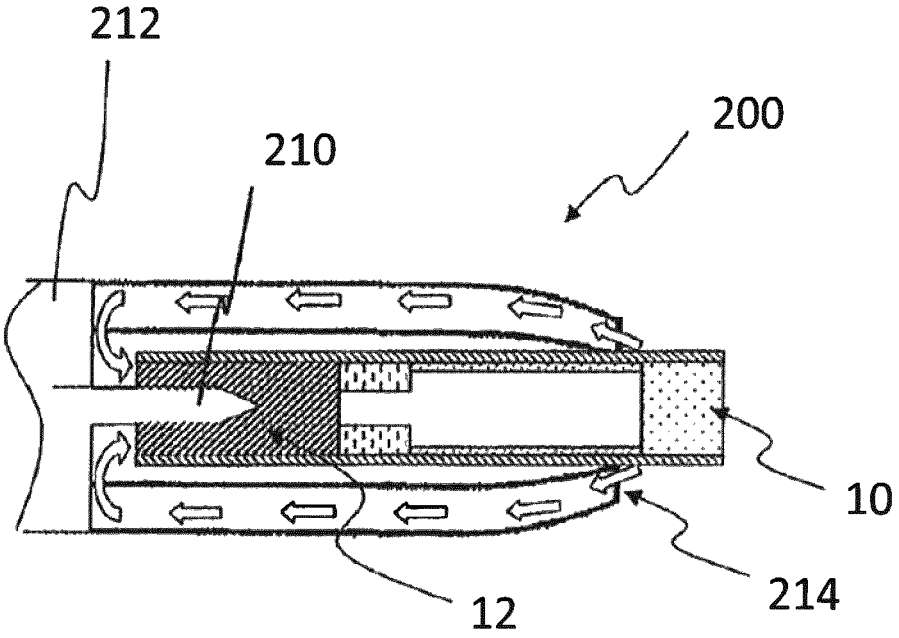
FIG. 4 shows a schematic longitudinal cross-sectional view of an aerosol-generating system comprising an electrically operated aerosol-generating device and the aerosol-generating article shown in FIG. 1.

FIG. 4 shows a portion of an electrically operated aerosol-generating system 200 that utilises a heater blade 210 to heat the rod of aerosol-generating substrate 12 of the aerosol-generating article 10 shown in FIG. 1. The heater blade 210 is mounted within an aerosol-generating article chamber within a housing of an electrically operated aerosol-generating device 212. The aerosol-generating device 212 defines a plurality of air holes 214 for allowing air to flow to the aerosol-generating article 10, as illustrated by the arrows in FIG. 4. The aerosol-generating device 212 comprises a power supply and electronics, which are not shown in FIG. 4.

The aerosol-generating article 10 shown in FIG. 1 is designed to engage with the aerosol-generating device 212 shown in FIG. 4 in order to be consumed. The user inserts the aerosol-generating article 10 into the aerosol-generating device 212 so that the heater blade 210 is inserted into the rod of aerosol-generating substrate 12, through the tubular elements of homogenised tobacco material 30. The mouthpiece filter 18 projects outwards from the mouth end of the device 212. Once the aerosol-generating article 10 is engaged with the aerosol-generating device 212, the user draws on the mouth end 22 of the aerosol-generating article 10 and the rod of aerosol-generating substrate 12 is heated by the heater blade 210 to a temperature sufficient to generate an aerosol from the rod of aerosol-generating substrate 12.

It will be appreciated that the aerosol-generating article 10 shown in FIG. 1 may also be suitable for use with other types of aerosol-generating devices.

The invention claimed is:

1. An aerosol-generating article for producing an inhalable aerosol when heated, the aerosol-generating article comprising:

a rod of aerosol-generating substrate, comprising:

a plurality of elongate tubular elements of homogenised tobacco material assembled such that the plurality of elongate tubular elements extend in a longitudinal direction, and a wrapper circumscribing the plurality of elongate tubular elements, wherein the plurality of elongate tubular elements are aligned substantially parallel to one another within the rod of aerosol-generating substrate, at least one elongate tubular element of the plurality of elongate tubular elements comprising a rolled strip of homogenised tobacco material, and wherein the rolled strip of homogenised tobacco material is a strip of a porous, homogenised tobacco material wound about a longitudinal axis by 360 degrees (1 convolution) to 1,800 degrees (5 convolutions).

2. The aerosol-generating article according to claim 1, wherein the at least one elongate tubular element has a thickness of at least 0.1 millimetre.

3. The aerosol-generating article according to claim 1, wherein the at least one elongate tubular element has a thickness of less than 3 millimetres.

4. The aerosol-generating article according to claim 1, wherein the rolled strip is textured.

5. The aerosol-generating article according to claim 1, wherein the rolled strip is embossed, punctured, or crimped.

6. The aerosol-generating article according to claim 1, wherein each elongate tubular element of the plurality of elongate tubular elements has a length substantially equal to a length of the rod of aerosol-generating substrate.

7. The aerosol-generating article according to claim 1, wherein the plurality of elongate tubular elements comprises less than 200 elongate tubular elements of homogenised tobacco material.

8. The aerosol-generating article according to claim 1, wherein the plurality of elongate tubular elements comprises at least 15 elongate tubular elements of homogenised tobacco material.

9. The aerosol-generating article according to claim 1, wherein elongate tubular elements of the plurality of elongate tubular elements of homogenised tobacco material are of substantially oval cross-section, substantially elliptical transverse cross-section, or substantially circular transverse cross-section.

10. The aerosol-generating article according to claim 1, wherein each elongate tubular element of the plurality of elongate tubular elements has an equivalent diameter of less than 3 millimetres.

11. The aerosol-generating article according to claim 1, wherein each elongate tubular element of the plurality of elongate tubular elements has an equivalent diameter of at least 0.1 millimetre.

12. The aerosol-generating article according to claim 1, wherein the wrapper circumscribing the plurality of elongate tubular elements is at least partially folded over the plurality of elongate tubular elements at upstream and downstream ends of the rod to retain the plurality of elongate tubular elements within the rod.

13. The aerosol-generating article according to claim 1, wherein the strip of homogenised tobacco material has a width from 1 millimetre to 8.2 millimetres.

14. The aerosol-generating article according to claim 1, wherein the strip of homogenised tobacco material has a width from 2.4 millimetres to 3.5 millimetres.

15. The aerosol-generating article according to claim 1, wherein the strip of homogenised tobacco material is cut from a sheet or web having a thickness between 80 microns and 1000 microns.

16. The aerosol-generating article according to claim 1, wherein the strip of homogenised tobacco material is cut from a sheet or web having a thickness between about 100 microns and about 500 microns.

* * * * *